US007167150B2

(12) United States Patent
Yang et al.

(10) Patent No.: US 7,167,150 B2
(45) Date of Patent: Jan. 23, 2007

(54) METHOD FOR DISPLAYING AN IMAGE, IMAGE DISPLAY APPARATUS, METHOD FOR DRIVING AN IMAGE DISPLAY APPARATUS AND APPARATUS FOR DRIVING AN IMAGE DISPLAY PANEL

(75) Inventors: Young-Chol Yang, Gunpo-si (KR); Mun-Pyo Hong, Seongnam-si (KR); Keun-Kyu Song, Seongnam-si (KR); Soo-Guy Rho, Suwon-si (KR); Nam-Seok Roh, Seongnam-si (KR); Ho-Yong Jung, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 469 days.

(21) Appl. No.: 10/830,346

(22) Filed: Apr. 22, 2004

(65) Prior Publication Data

US 2005/0184998 A1 Aug. 25, 2005

(30) Foreign Application Priority Data

Feb. 23, 2004 (KR) ..... 10-2004-0011956

(51) Int. Cl.
*G09G 3/36* (2006.01)

(52) U.S. Cl. ..... 345/89; 345/102; 345/589; 345/590; 345/690

(58) Field of Classification Search ..... None
See application file for complete search history.

(56) References Cited

U.S. PATENT DOCUMENTS

| | | | | |
|---|---|---|---|---|
| 6,140,986 | A * | 10/2000 | Wilkinson et al. | 345/74.1 |
| 6,351,077 | B1 * | 2/2002 | Koyama | 315/169.3 |
| 6,862,012 | B1 * | 3/2005 | Funakoshi et al. | 345/88 |
| 2004/0160435 | A1 * | 8/2004 | Cui et al. | 345/211 |
| 2006/0071899 | A1 * | 4/2006 | Chang et al. | 345/102 |
| 2006/0146007 | A1 * | 7/2006 | Lim et al. | 345/102 |

* cited by examiner

*Primary Examiner*—Mark Zimmerman
*Assistant Examiner*—Jwalant Amin
(74) *Attorney, Agent, or Firm*—F. Chau & Associates, LLC

(57) ABSTRACT

A method of displaying an image using an image display device in which the image display device has an artificial light source includes inputting primary image signals to the image display device, determining chroma state of the primary image signals for each image frame, and determining gray-scale state of the primary image signals for each image frame. The primary image signals are transformed to multi-color image signals and luminance of the artificial light source is controlled, in response to the determined chroma state and gray-scale state of the primary image signals.

34 Claims, 13 Drawing Sheets

METHOD FOR DISPLAYING AN IMAGE, IMAGE DISPLAY APPARATUS, METHOD FOR DRIVING AN IMAGE DISPLAY APPARATUS AND APPARATUS FOR DRIVING AN IMAGE DISPLAY PANEL

BACKGROUND

1. Technical Field

The present disclosure relates to a method and apparatus for displaying an image, and a method and apparatus for driving a display apparatus. More particularly, the present disclosure relates to a method and apparatus for displaying an image with adaptive color-transformation and increased luminance, and a method and apparatus for driving the display apparatus.

2. Discussion of Related Art

In an image display apparatus, additional colors may be added to three primary colors of each pixel to increase luminance and improve image display quality. The three primary colors include red (R), green (G) and blue (B).

FIGS. 1A to 1C are plan views showing a conventional arrangement of pixels. FIG. 1A is a plan view showing R, G and B subpixels. FIG. 1B is a plan view showing R, G, B and white (W) subpixels. FIG. 1C is a plan view showing R, G, B, cyan (C), magenta (M) and yellow (Y) subpixels.

Referring to FIG. 1B, the W subpixel is added to the three primary colored subpixels to increase the luminance of the display apparatus.

Referring to FIG. 1C, C, M and Y colored subpixels are added to the three primary colored subpixels to increase the color gamut of the display apparatus.

When one of the primary colors having a high chroma is displayed by a display apparatus, the luminance of the display apparatus may be decreased. In addition, although a display apparatus having RGBW subpixels displays an achromatic color with increased luminance, the luminance of the primary colors may be decreased.

For example, when an image of flowers having various colors are displayed on a white background using RGBW subpixels, the luminance of the background increases in inverse proportion to the luminance of the flowers that have the primary colors. Therefore, the image display quality of the flower may be deteriorated.

When the same image is displayed using RGBCMY subpixels, the luminance of the background also increases in inverse proportion to the luminance of the flowers that have the primary colors. Further, the luminance of the primary colors in the RGBCMY type display apparatus decreases in proportion to the area of the RGB subpixels.

In addition to using subpixels having divided areas, multi-color images may also be displayed using divided time periods during which the subpixels are activated. However, the problems discussed above are also associated with images displayed using divided time periods.

Accordingly, there is a need for an image display apparatus in which the luminance and color transformation are controlled to improve image quality.

SUMMARY OF THE INVENTION

A method of displaying an image using an image display device in which the image display device has an artificial light source according to an exemplary embodiment of the invention includes inputting primary image signals to the image display device, determining chroma state of the primary image signals for each image frame, and determining gray-scale state of the primary image signals for each image frame. The primary image signals are transformed to multi-color image signals and luminance of the artificial light source is controlled, in response to the determined chroma state and gray-scale state of the primary image signals.

An image display apparatus according to an exemplary embodiment of the invention includes a transformation controller that transforms primary image signals to multi-color image signals and outputs a luminance control signal, in response to determined chroma state and gray-scale state of the primary image signals. A data driver outputs data signals in response to the multi-color image signals and a scan driver successively outputs scan signals. A display panel displays an image corresponding to the data signals in response to the scan signals. A light source supplies light to the display panel in response to the luminance control signal.

A method for driving an image display apparatus in which the image display apparatus has a display panel and a light source according to exemplary embodiment of the invention includes inputting primary image signals to the image display apparatus, determining chroma state of the primary image signals for each image frame, and determining gray-scale state of the primary image signals for each image frame. The primary image signals are transformed to multi-color image signals and a luminance control signal is output, in response to the determined chroma state and gray-scale state of the primary image signals. Image data is applied to the display panel in response to the multi-color image signals. The light source is controlled in response to the luminance control signal to output light to the display panel.

An apparatus for driving an image display panel according to an exemplary embodiment of the invention, in which the image display panel has a plurality of gate lines, a plurality of data lines, a switching element electrically connected to one of the gate lines and one of the data lines, and a pixel electrode electrically connected to the switching element, the display panel displaying an image corresponding to data signals in response to scan signals, includes a transformation controller that transforms primary image signals to multi-color image signals and outputs a luminance control signal, in response to determined chroma state and gray-scale state of the primary image signals. A data driver outputs the data signals to the plurality of data lines in response to the multi-color image signals. A scan driver successively outputs the scan signals to the plurality of gate lines. A light source supplies light to the display panel in response to the luminance control signal.

BRIEF DESCRIPTION OF THE DRAWINGS

Exemplary embodiments of the present invention will be described in detail with reference to the attached drawings in which.

DESCRIPTION OF PREFERRED EMBODIMENTS

Figure 1A:
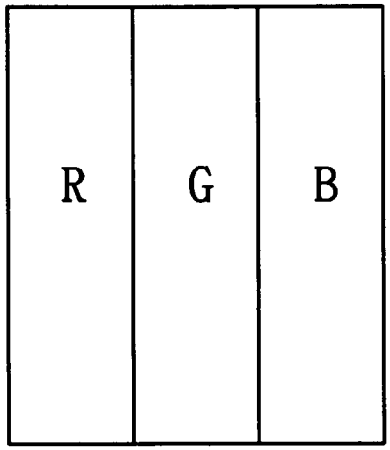
FIGS. 1A to 1C are plan views showing conventional arrangements of pixels.
Figure 1B:
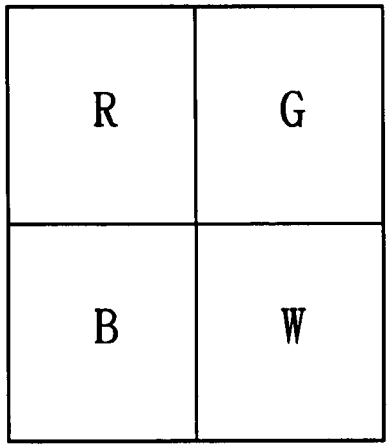
Figure 1C:
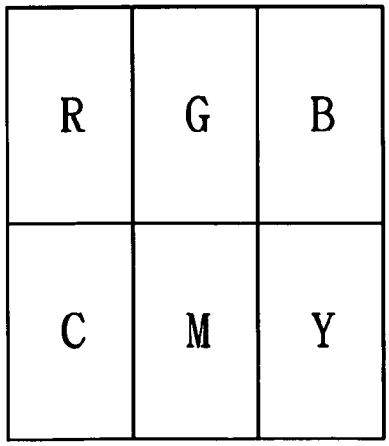

Reference will now be made in detail to embodiments of the invention, an example of which is illustrated in the accompanying drawings, in which like reference characters refer to corresponding elements.

Figure 2:
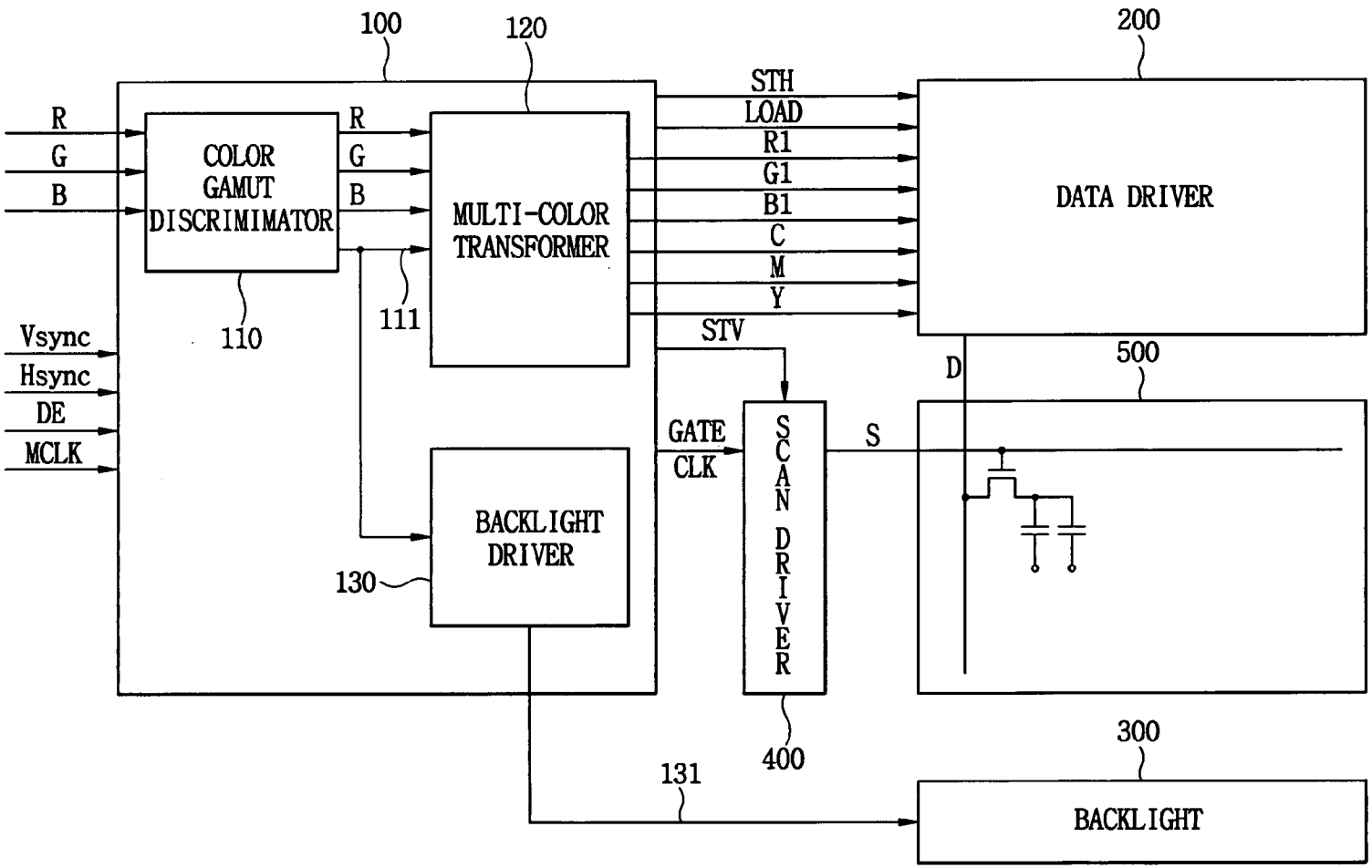
FIG. 2 is a schematic view showing an LCD apparatus in accordance with an exemplary embodiment of the present invention.

FIG. 2 is a schematic view showing an LCD apparatus in accordance with an exemplary embodiment of the present invention. The LCD apparatus may display a multi-color image. The multi-color image may be displayed using pixels each including at least four subpixels that have different color coordinates from one another. The multi-color image may include four primary colors.

Primary image signals define a triangle in a visible color gamut of x-y color coordinates. Multi-color image signals define a polygon including the triangle in the visible color gamut of the x-y color coordinates. The polygon includes at least four sides. Red (R), green (G) and blue (B) primary colors corresponds to wavelengths of about 650 nm, about 550 nm and about 450 nm, respectively.

Referring to FIG. 2, the LCD apparatus according to the present embodiment of the invention includes a transformation controller 100, a data driver 200, a backlight 300, a scan driver 400 and an LCD panel 500.

The transformation controller 100 includes a discriminating part 110, a multi-color-transformer 120 and a backlight controller 130. The transformation controller 100 receives primary image signals (R, G and B) to output multi-color image signals (R1, G1, B1, C, M and Y) in response to a chroma of each of the primary image signals (R, G and B) and a gray-scale of each of the primary image signals (R, G and B). The transformation controller 100 outputs the multi-color image signals (R1, G1, B1, C, M and Y) to the data driver 200. The chroma of a color is measured relative to an achromatic color. For example, if the chroma of an achromatic color is 0, the chroma of a primary color is 10.

The transformation controller 100 outputs a first control signal to the data driver 200. The first control signal controls output of the multi-color image signals (R1, G1, B1, C, M, Y) in response to a vertical synchronizing signal (Vsync), a horizontal synchronizing signal (Hsync), a data enable signal (DE) and a main clock (MCLK) that are provided together with the primary image signals (R, G and B). The first control signal includes a horizontal synchronizing start signal (STH) and a load signal (LOAD). The horizontal synchronizing start signal (STH) controls storage of normal data or predetermined data. The load signal (LOAD) controls output of the stored multi-color image signals (R1, G1, B1, C, M and Y).

The transformation controller 100 outputs a second control signal to the scan driver 400 during 1 H period. The second control signal controls an image signal display in response to the multi-color image signals (R1, G1, B1, C, M and Y). The second control signal includes a gate clock (GATE CLK) and a vertical synchronizing start signal (STV). The gate clock (GATE CLK) corresponds to a next scan line. The vertical synchronizing start signal (STV) corresponds to a first scan line.

The data driver 200 receives the horizontal synchronizing start signal (STH), and stores the multi-color image signals (R1, G1, B1, C, M and Y). The data driver 200 outputs analog-transformed data (D) that is transformed from the stored multi-color image signals (R1, G1, B1, C, M and Y) in response to the load signal (LOAD). The data driver 200 outputs the analog-transformed data (D) to the LCD panel 500.

The backlight 300 includes a lamp unit and an inverter supplying power to the lamp unit. The backlight 300 supplies light to the LCD panel 500 in response to a luminance control signal 131. When the luminance control signal 131 is high level, the backlight 300 supplies a light having high intensity to the LCD panel 500. When the luminance control signal 131 is low level, the backlight 300 supplies a light having low intensity to the LCD panel. Therefore, the luminance of the LCD apparatus may be adjusted.

The scan driver 400 successively outputs a scan signal (S) in response to the gate clock (GATE CLK) and the vertical synchronizing start signal (STV).

The LCD panel 500 includes a plurality of pixel electrodes that are arranged in a matrix shape. The matrix is made of m×n pixel electrodes. When the scan signal (S) is applied to each of the pixels, the pixel electrode is operated in response to the data signal (D). The data driver 200 supplies the data signal (D) to the LCD panel 500. Therefore, the LCD panel 500 displays the image using the light generated from the backlight 300.

The colors which can be matched by combining a given set of three primary colors such as the blue, green, and red are represented on a chromaticity diagram by a triangle joining the coordinates for the three colors. When the primary image signal is applied to the LCD apparatus, the LCD apparatus displays a color that is matched from the triangular region formed by the R, G and B primary colors so that the multi-color image signal defines a polygon including the triangle. The polygon includes at least four sides.

Figure 3:
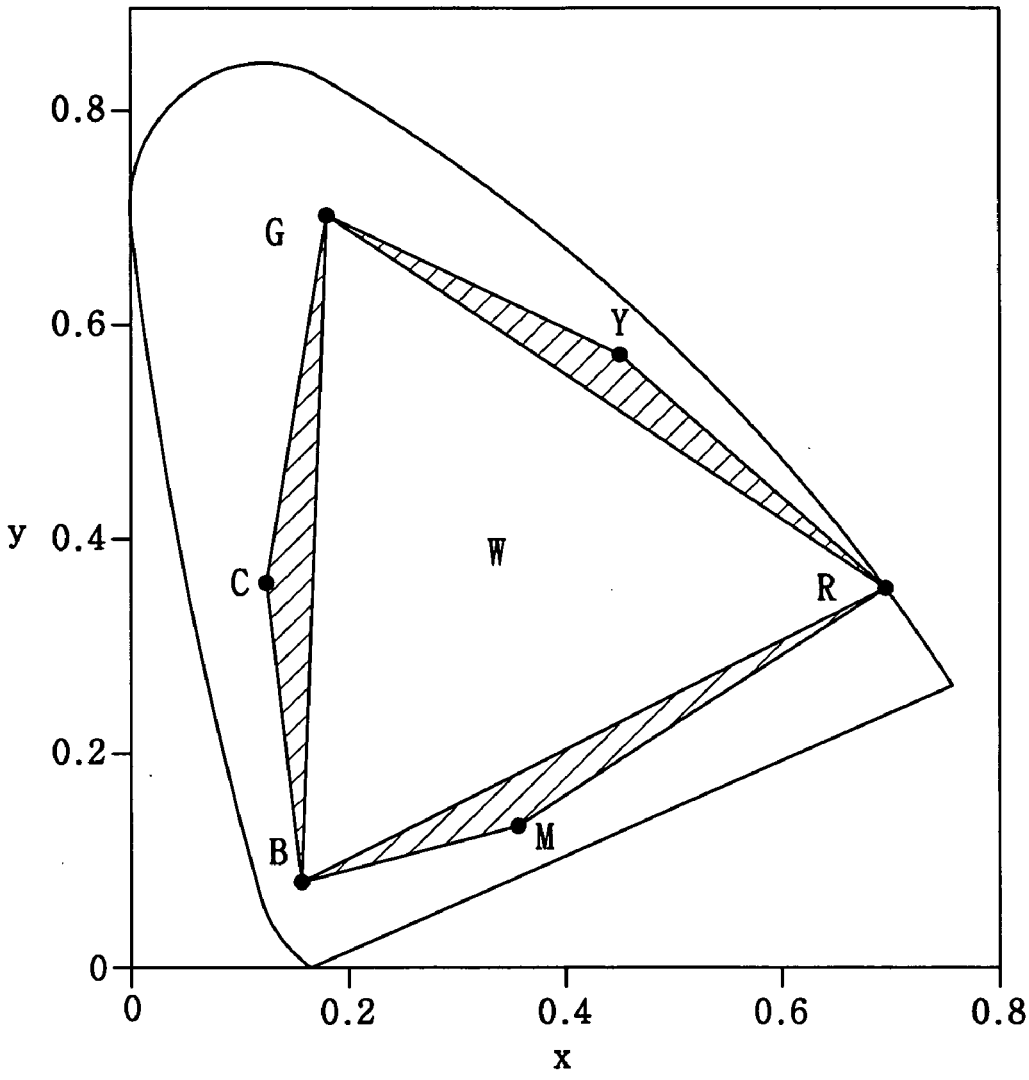
FIG. 3 is a chromaticity diagram showing an expanded color region in accordance with an exemplary embodiment of the present invention.
Figure 4A:
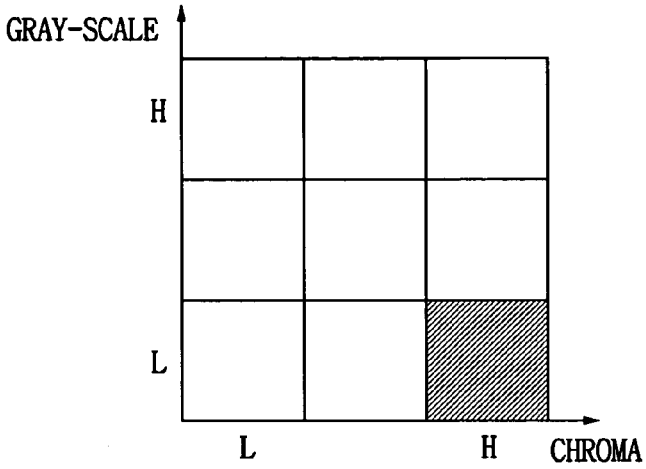
FIGS. 4A to 4G are graphs showing relationships between gray-scale and chroma in accordance with an exemplary embodiment of the present invention.
Figure 4B:
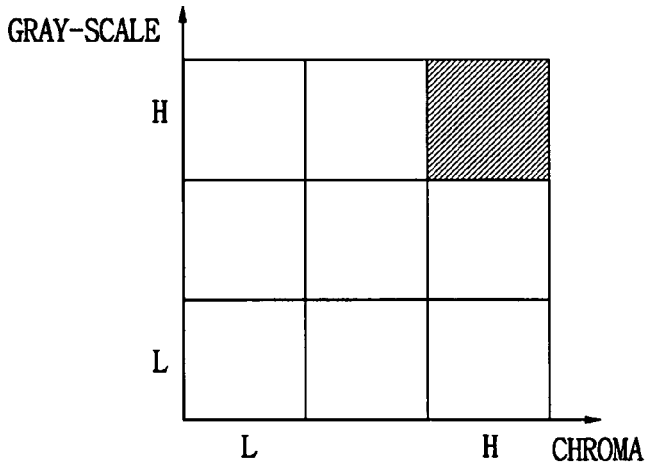
Figure 4C:
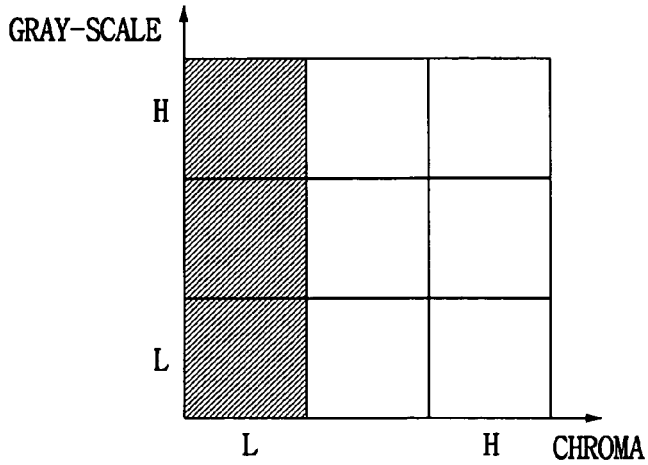
Figure 4D:
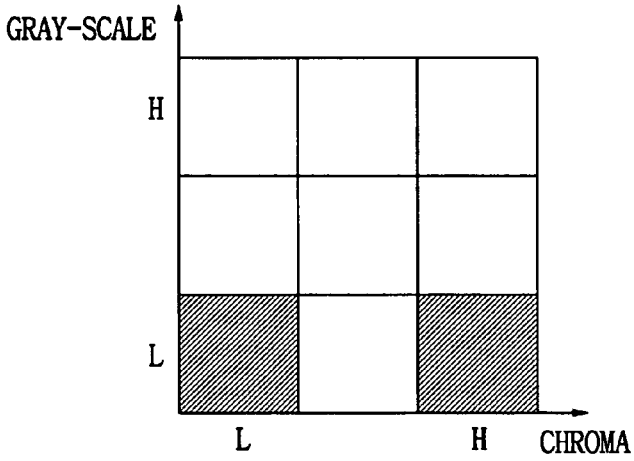
Figure 4E:
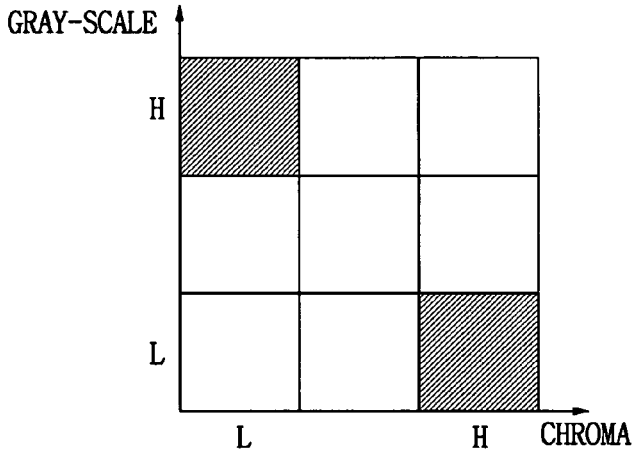
Figure 4F:
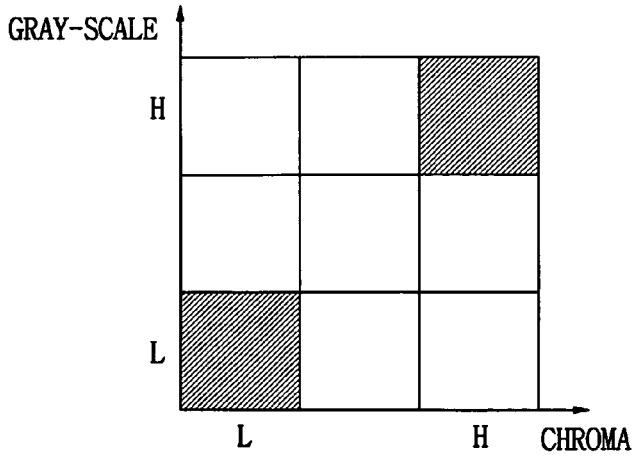
Figure 4G:
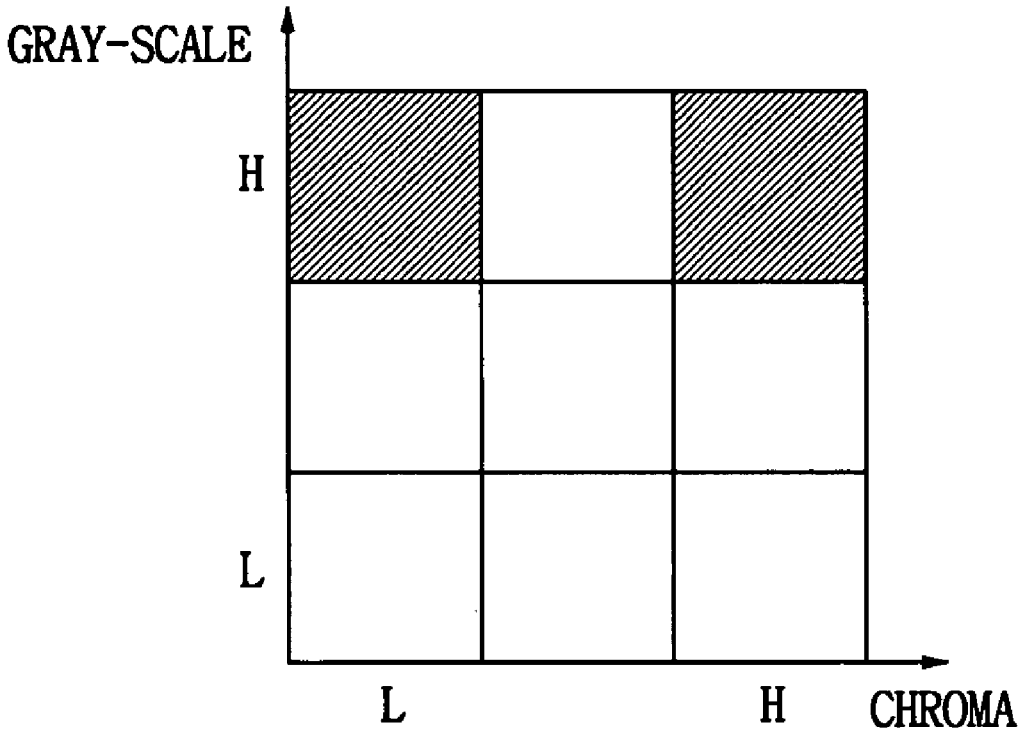

FIG. 3 is a chromaticity diagram showing an expanded color region in accordance with an exemplary embodiment of the present invention.

Referring to FIG. 3, the 1943 CIE color coordinates corresponding to the primary image signals (R, G and B) are graphed at positions different from one another to form the triangle in the chromaticity diagram. A color of an image which can be matched by combining R, G, and B falls within the triangle joining the coordinates for R, G, and B.

The difference between the color coordinates corresponding to the primary image signals (R, G and B) satisfies equation 1.

$$(\Delta x^2+\Delta y2)^{1/2}<0.15 \qquad \text{Equation 1}$$

A polygon formed by the color coordinates corresponding to the multi-color image signals (R1, G1, B1, C, M and Y) includes the triangle so that the image display quality may be improved. The difference between the color coordinates corresponding to the multi-color image signals (R1, G1, B1, C, M and Y) also satisfies equation 1.

Therefore, the area corresponding to the multi-color image signals (R1, G1, B1, C, M and Y) is larger than the area corresponding to the triangular image signals (R, G and B).

FIGS. 4A to 4G are graphs showing relationships between gray-scale and chroma in accordance with an exemplary embodiment of the present invention. Table 1 represents primary image signals and methods for processing gray-scale.

TABLE 1

| Case (FIG.) | Characteristics of Primary Image Signal | Compensation During Multi-Color transformation | Operation of Luminance of Backlight |
|---|---|---|---|
| I (4A) | High Chroma & Low Gray-Scale | Increasing Gray-Scale | Normal Operation |
| II (4B) | High Chroma & High Gray-Scale | Normal Multi-Color-transformation | Increasing Luminance |
| III (4C) | Low Chroma | Normal Multi-Color-transformation | Normal Operation |
| IV (4D) | (High Chroma & Low Gray-Scale) + (Low Chroma & Low Gray-Scale) | Increasing Gray-Scale for High Chroma Data Normal Multi-Color transformation for Low Chroma Data | Normal Operation |
| V (4E) | (High Chroma & Low Gray-Scale) + (Low Chroma & High Gray-Scale) | Increasing Gray-Scale for High Chroma Data Normal Multi-Color transformation for Low Chroma Data | Normal Operation |
| VI (4F) | (High Chroma & High Gray-Scale) + (Low Chroma & Low Gray-Scale) | Normal Multi-Color transformation | Normal Operation or Increasing Luminance |
| VII (4G) | (High Chroma & High Gray-Scale) + (Low Chroma & High Gray-Scale) | Decreasing Gray-Scale for High Chroma Data Normal Multi-Color transformation for Low Chroma Data | Increasing Luminance |

Referring to FIGS. 4A to 4G, in case I of this exemplary embodiment, when the primary image signals include high chroma and low gray-scale, the gray-scale of the primary image signals is increased to output the multi-color image signals, and the backlight is normally operated. That is, the luminance of the backlight is not increased, although the primary image signals include high chroma. Therefore, the image display quality is improved.

Although the primary image signals corresponding to one frame have high chroma, the luminance of the backlight may not be increased, because the power consumption of the backlight increases in proportion to the luminance of the backlight.

In case II of this exemplary embodiment, when the primary image signals include high chroma corresponding to high gray-scale, the multi-color transformation may be insufficient for the compensation. Therefore, the primary image signals are normally multi-color transformed, and the luminance of the backlight is increased to improve the image display quality.

When the primary image signals include a mixture of high chroma and low chroma, luminance of a color image signal may be decreased, resulting in deterioration of the image display quality. For example, when the primary image signals include a mixture of high chroma corresponding to high gray-scale and low chroma corresponding to high gray-scale, the color luminance corresponding to the high chroma is decreased, resulting in deterioration of the image display quality. For example, when red flowers are displayed in a white background, the luminance of the red flowers may be decreased so that brownish red flowers may be displayed. When the luminance of the backlight is increased, the luminance of the background increases in proportion to the luminance of the entire LCD panel, thereby deteriorating the display quality.

In case VII of the exemplary embodiment, although the primary image signals include a mixture of high chroma corresponding to high gray-scale and low chroma corresponding to high gray-scale, the luminance of the achromatic color is decreased, and the luminance of the backlight is not increased so as to improve the image display quality.

Figure 5A:
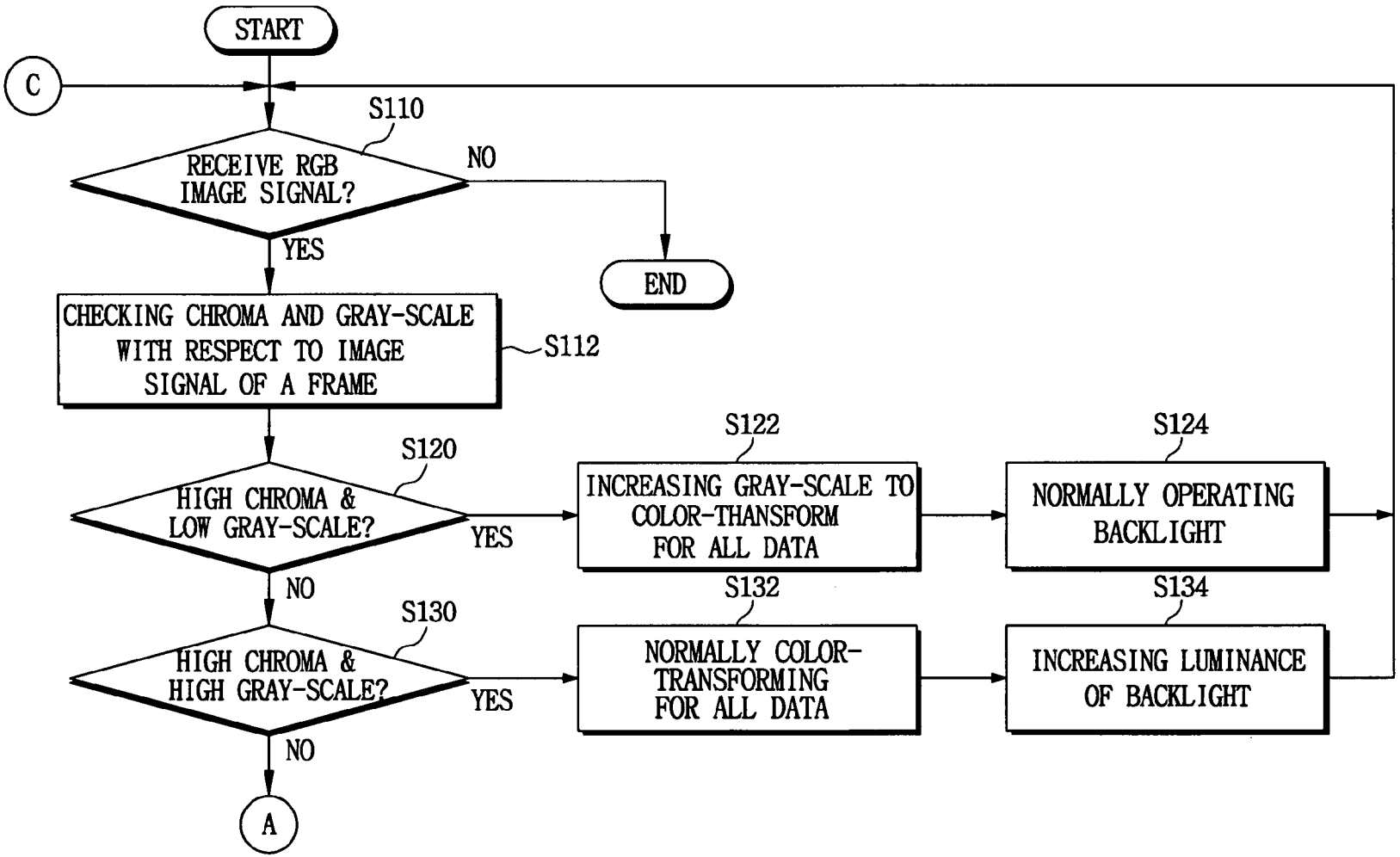
FIGS. 5A to 5C are flow charts showing a method of driving an LCD apparatus in accordance with an exemplary embodiment of the present invention.
Figure 5B:
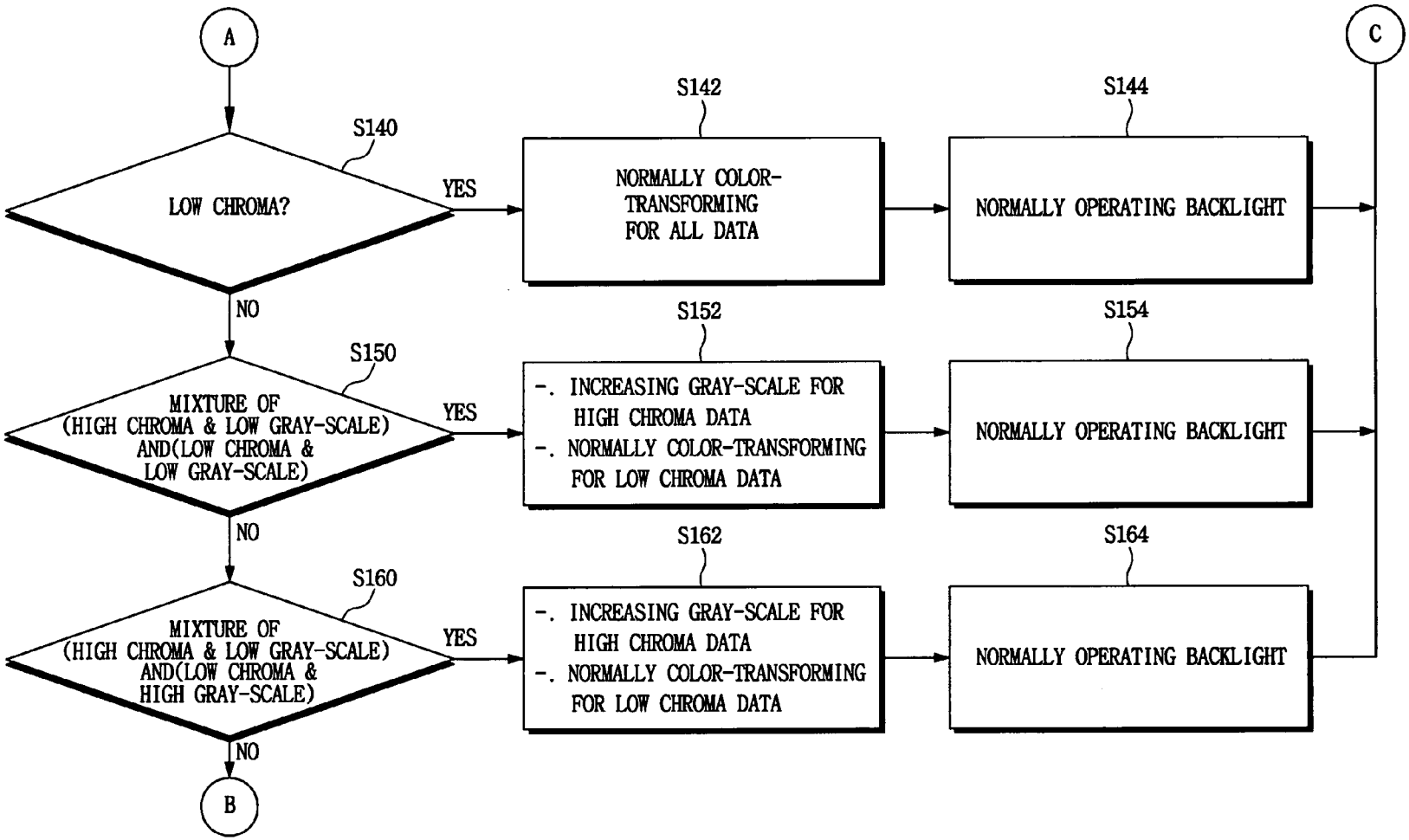
Figure 5C:
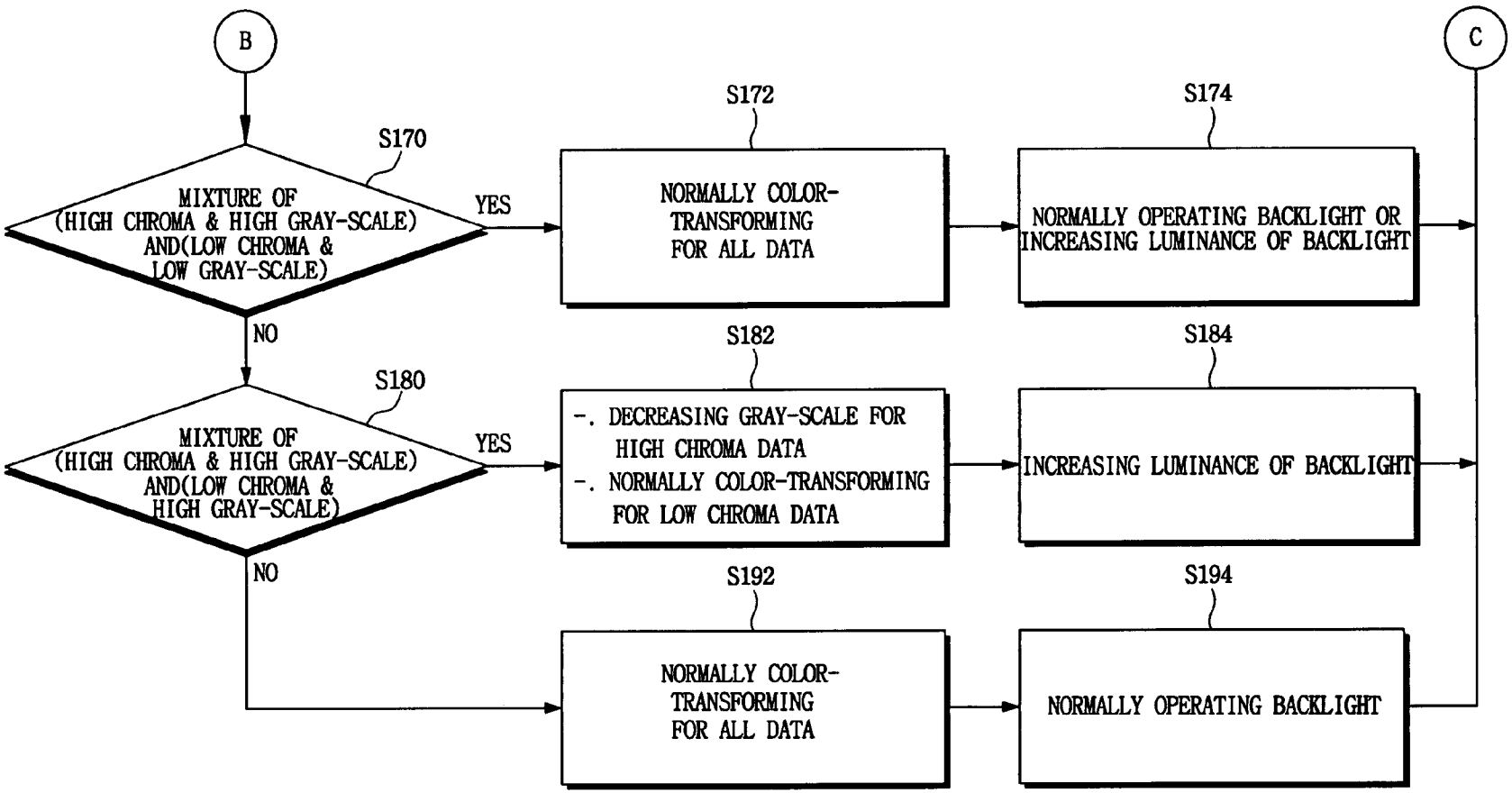

FIGS. 5A to 5C are flow charts showing a method of driving an LCD apparatus in accordance with an exemplary embodiment of the present invention.

Referring to FIGS. 5A to 5C, reception of the primary image signals (R, G and B) is checked (Step S110). When the primary image signals (R, G and B) are received, the chroma and the gray-scale are checked with respect to reference primary image signals (R', G' and B') (Step S112). The reference primary image signals (R', G' and B') may be determined in response to the primary image signals (R, G and B). The reference primary image signals (R', G' and B') may also be primary image signals corresponding to a previous frame.

The primary image signals (R, G and B) are compared with the reference primary image signals (R', G' and B') to determine whether the primary image signals (R, G and B) of one frame include high chroma corresponding to low gray-scale (Step S120). When the primary image signals (R, G and B) of the frame include high chroma corresponding to low gray-scale, the primary image signals (R, G and B) are color-transformed to the multi-color image signals (R1, G1, B1, C, M and Y), and the gray-scale of all the gray-scale data corresponding to the multi-color image signals (R1, G1, B1, C, M and Y) is increased during the color-transformation (Step S122). The backlight is normally operated (Step S124), and the process is feed backed to the step S110. In other exemplary embodiments of the invention, the step S124 may be performed prior to the step S122.

When the primary image signals (R, G and B) of the frame do not include high chroma corresponding to low gray-scale, the primary image signals (R, G and B) are compared with the reference primary image signals (R', G' and B') to determine whether the primary image signals (R, G and B) of the frame include high chroma corresponding to high gray-scale (Step S130). When the primary image signals (R, G and B) of the frame include high chroma corresponding to high gray-scale, the gray-scale of all the gray-scale data corresponding to the primary image signals (R, G and B) are color-transformed to the multi-color image signals (R1, G1, B1, C, M and Y) (Step S132), and the luminance of the backlight is increased (Step S134). The process is feed backed to the step S110.

When the primary image signals (R, G and B) of the frame do not include high chroma corresponding to high gray-scale, the primary image signals (R, G and B) are compared with the reference primary image signals (R', G' and B') to determine whether the primary image signals (R, G and B) of the frame include low chroma (Step S140). When the primary image signals (R, G and B) of the frame include low chroma, the gray-scale of all the gray-scale data corresponding to the primary image signals (R, G and B) are color-transformed to the multi-color image signals (R1, G1, B1, C, M and Y) (Step S142), and the backlight is normally operated (Step S144). The process is feed backed to the step S110.

When the primary image signals (R, G and B) of the frame do not include low chroma, the primary image signals (R, G and B) are compared with the reference primary image signals (R', G' and B') to determine whether the primary image signals (R, G and B) of the frame include a mixture of high chroma corresponding to low gray-scale and low chroma corresponding to low gray-scale (Step S150). When the primary image signals (R, G and B) of the frame include a mixture of high chroma corresponding to low gray-scale and low chroma corresponding to low gray-scale, the gray-scale of the gray-scale data corresponding to the low chroma is normally color-transformed to the multi-color image signals (R1, G1, B1, C, M and Y), and the gray-scale corresponding to the high chroma is increased during the color-transformation (Step S152). The backlight is normally operated (Step S154). The process is feed backed to the step S110.

When the primary image signals (R, G and B) of the frame do not include a mixture of high chroma corresponding to low gray-scale and low chroma corresponding to low gray-scale, the primary image signals (R, G and B) are compared with the reference primary image signals (R', G' and B') to determine whether the primary image signals (R, G and B) of the frame include a mixture of high chroma corresponding to low gray-scale and low chroma corresponding to high gray-scale (Step S160). When the primary image signals (R, G and B) of the frame include a mixture of high chroma corresponding to low gray-scale and low chroma corresponding to high gray-scale, the gray-scale of the gray-scale data corresponding to the low chroma is color-transformed to the multi-color image signals (R1, G1, B1, C, M and Y), and the gray-scale corresponding to the high chroma is increased during the color-transformation (Step S162). The backlight is normally operated (Step S164). The process is feed backed to the step S110.

When the primary image signals (R, G and B) of the frame do not include a mixture of high chroma corresponding to low gray-scale and low chroma corresponding to high gray-scale, the primary image signals (R, G and B) are compared with the reference primary image signals (R', G' and B') to determine whether the primary image signals (R, G and B) of the frame include a mixture of high chroma corresponding to high gray-scale and low chroma corresponding to low gray-scale (Step S170). When the primary image signals (R, G and B) of the frame include a mixture of high chroma corresponding to high gray-scale and low chroma corresponding to low gray-scale, the gray-scale of all the gray-scale data corresponding to the primary image signals (R, G and B) are color-transformed to the multi-color image signals (R1, G1, B1, C, M and Y) (Step S172). The backlight is normally operated, or the luminance of the backlight is increased (Step S174). The process is feed backed to the step S110.

When the primary image signals (R, G and B) of the frame include a mixture of high chroma corresponding to high gray-scale and low chroma corresponding to low gray-scale, the primary image signals (R, G and B) are compared with the reference primary image signals (R', G' and B') to determine whether the primary image signals (R, G and B) of the frame include a mixture of high chroma corresponding to high gray-scale and low chroma corresponding to high gray-scale (Step S180). When the primary image signals (R, G and B) of the frame include a mixture of high chroma corresponding to high gray-scale and low chroma corresponding to high gray-scale, the gray-scale of all the gray-scale data corresponding to the low chroma is color-transformed to the multi-color image signals (R1, G1, B1, C, M and Y), and the gray-scale of the high chroma is decreased (Step S182). The luminance of the backlight is increased (Step S184). The process is feed backed to the step S110.

When the primary image signals (R, G and B) of the frame do not include a mixture of high chroma corresponding to high gray-scale and low chroma corresponding to high gray-scale, the gray-scale of all the gray-scale data corresponding to the primary image signals (R, G and B) are normally color-transformed to the multi-color image signals (R1, G1, B1, C, M and Y) (Step S192), and the backlight is normally operated (Step S194). The process is feed backed to the step S110.

Figure 6:
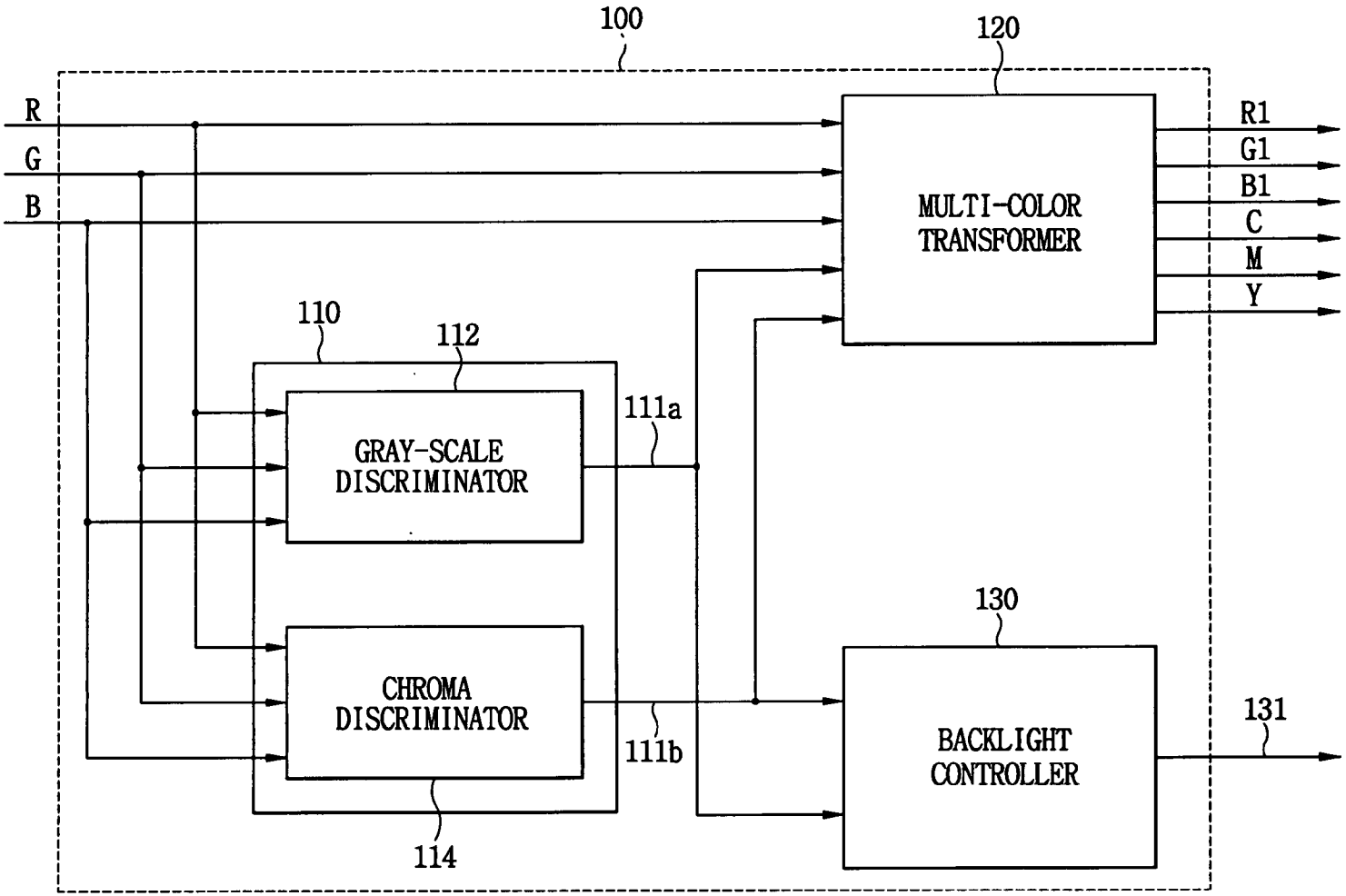
FIG. 6 is a schematic view showing the transformation controller of FIG. 2.

FIG. 6 is a schematic view showing the transformation controller of FIG. 2.

Referring to FIG. 6, the transformation controller 100 includes a discriminating part 110, a multi-color transformer 120 and a backlight controller 130. The transformation controller 100 receives the primary image signals (R, G and B) to output the luminance control signal 131 in response to the chroma and the gray-scale of the primary image signals (R, G and B).

The discriminating part 110 includes a gray-scale discriminator 112 and a chroma discriminator 114. The discriminating part 110 discriminates the chroma and the gray-scale of the primary image signals (R, G and B) to output a gray-scale state signal 111*a* and a chroma state signal 111*b* to the multi-color transformer 120 and the backlight controller 130.

The gray-scale discriminator 112 discriminates a gray-scale state of each of the primary image signals (R, G and B) to output the gray-scale state signal 111*a* corresponding to a low gray-scale, a middle gray-scale or a high gray-scale to the multi-color transformer 120 and the backlight controller 130. For example, when a full gray-scale is 256, and the primary image signals (R, G and B) are 10, 10 and 255, respectively, the gray-scale state signal corresponding to the R primary image signal and the gray-scale state signal corresponding to the G primary image signal are in low gray-scale states, and the gray-scale state signal corresponding to the B primary image signal is in a high gray-scale state.

The chroma discriminator 114 discriminates a chroma state of each of the primary image signals (R, G and B) to output the chroma state signal 111*b* corresponding to a low chroma, a middle chroma or a high chroma to the multi-color transformer 120 and the backlight controller 130. The chroma state is a ratio of a minimum gray-scale to a maximum gray-scale among the gray-scales of the primary image signals (R, G and B).

The chroma state signal is a rational number that is about 0 to 1. The high chroma state is about 0 to 0.3, and the low chroma state is about 0.7 to 1. For example, when a full gray-scale is 256, and the primary image signals (R, G and B) are 10, 10 and 255, respectively, the minimum and maximum gray-scales are 10 and 255, respectively. Therefore, the ratio of the minimum to maximum gray-scale is about 0.039, and the chroma state signal is in a high chroma state. In addition, when the primary image signals (R, G and B) are 200, 200 and 200, respectively, the minimum and maximum gray-scales are 200. Therefore, the ratio of the minimum to maximum gray-scale is 1, and the chroma state signal is in a low chroma state.

The multi-color transformer 120 transforms the primary image signals (R, G and B) to the multi-color image signals (R1, G1, B1, C, M and Y) in response to the gray-scale state signal 111*a* and the chroma state signal 111*b* to output the multi-color image signals (R1, G1, B1, C, M and Y) to the data driving part 200.

The backlight controller 130 outputs the luminance control signal 131 to the backlight 300 in response to the gray-scale state signal 111*a* and the chroma state signal 111*b*.

Figure 7:
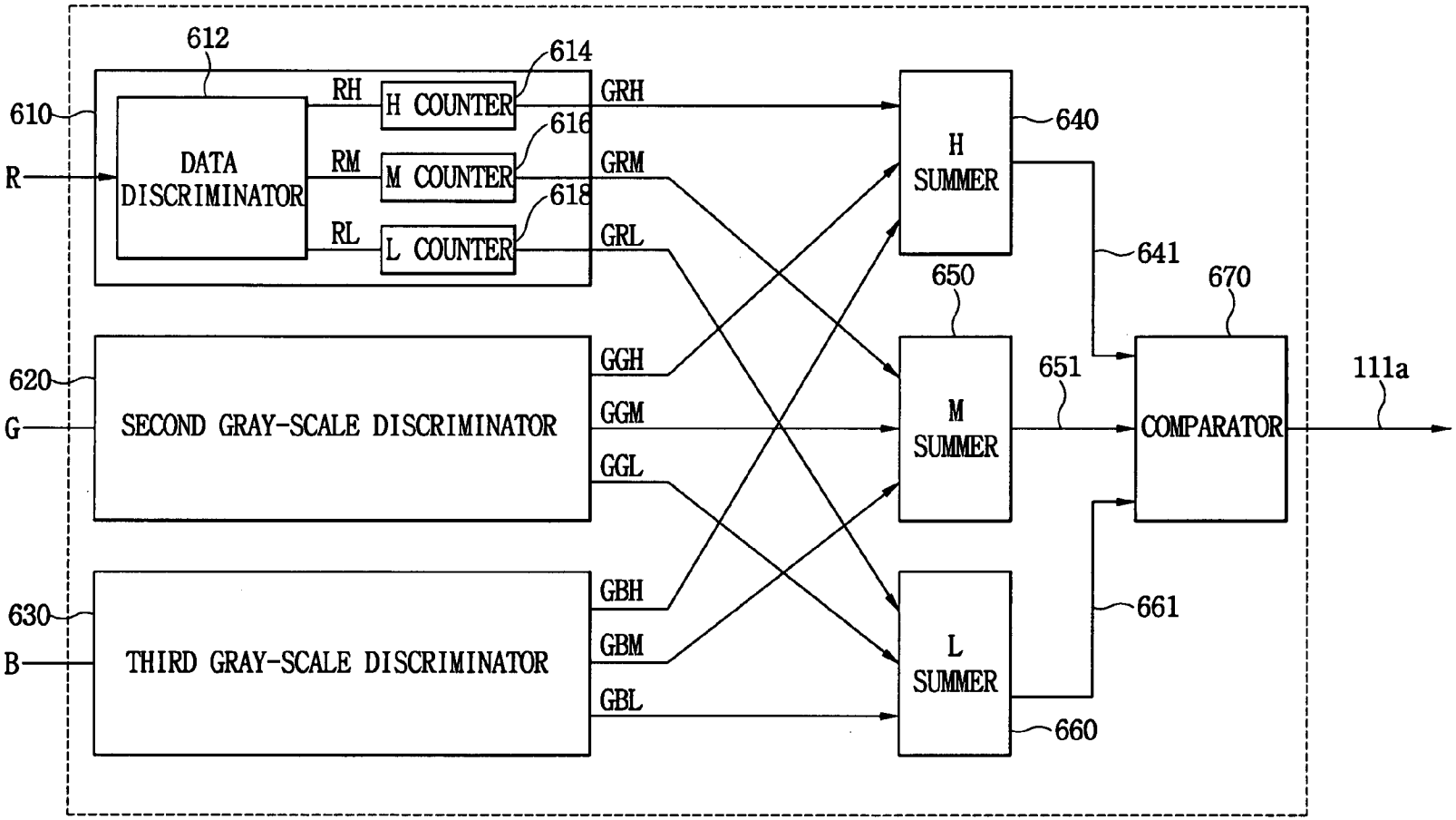
FIG. 7 is a schematic view showing the gray-scale discriminator of FIG. 6.

FIG. 7 is a schematic view showing the gray-scale discriminator of FIG. 6.

Referring to FIG. 7, the gray-scale discriminator 112 includes a first gray-scale discriminator 610, a second gray-scale discriminator 620, a third gray-scale discriminator 630, a first summer 640, a second summer 650, a third summer 660 and a comparator 670.

The first gray-scale discriminator 610 includes a data discriminator 612, a first counter 614, a second counter 616 and a third counter 618. The first gray-scale discriminator 610 counts the number of high, middle and low gray-scale states corresponding to the R primary image signal and outputs the count data to the first, second and third summers 640, 650 and 660, respectively.

The data discriminator 612 discriminates the R primary image signal to output the gray-scale state to the first, second and third counters 614, 616 and 618. That is, when the R primary image signal is in a high gray-scale state (RH), the data discriminator 612 outputs the high gray-scale state (RH) to the first counter 614. When the R primary image signal is in a middle gray-scale state (RM), the discriminator 612 outputs the middle gray-scale state (RM) to the second counter 616. When the R primary image signal is in a low gray-scale state (RL), the discriminator 612 outputs the low gray-scale state (RL) to the third counter 618.

When the R primary image signal including the high gray-scale state (RH) is applied to the first counter 614, the number of the R primary image signal including the high gray-scale state (RH) is counted so that the first counter 614 outputs first R count data (GRH) to the first summer 640.

When the R primary image signal including the middle gray-scale state (RM) is applied to the second counter 616, the number of the R primary image signal including the middle gray-scale state (RM) is counted so that the second counter 616 outputs second R count data (GRM) to the second summer 650.

When the R primary image signal including the low gray-scale state (RL) is applied to the third counter 618, the number of the R primary image signal including the low gray-scale state (RL) is counted so that the third counter 618 outputs third R count data (GRL) to the third summer 660.

The second gray-scale discriminator 620 includes a G data discriminator (not shown), a first G counter (not shown), a second G counter (not shown) and a third G counter (not shown). The second gray-scale discriminator 620 counts the number of high, middle and low gray-scale states corresponding to the G primary image signal and outputs the count data to the first, second and third summers 640, 650 and 660, respectively. The second gray-scale discriminator 620 counts the numbers of the G primary image signals including the high, middle and low gray-scale states (GH, GM and GL) to output first G count data (GGH), second G count data (GGM) and third G count data (GGL) to the first, second and third summers 640, 650 and 660, respectively.

The third gray-scale discriminator 630 includes a B data discriminator (not shown), a first B counter (not shown), a second B counter (not shown) and a third B counter (not shown). The third gray-scale discriminator 630 counts the number of high, middle and low gray-scale states corresponding to the B primary image signal and outputs the count data to the first, second and third summers 640, 650 and 660, respectively. The third gray-scale discriminator 630 counts the numbers of the B primary image signals including the high, middle and low gray-scale states (BH, BM and BL) to output first B count data (GBH), second B count data (GBM) and third B count data (GBL) to the first, second and third summers 640, 650 and 660, respectively.

The first summer 640 outputs first summation data 641 that is a summation of the first R count data (GRH), the first G count data (GGH) and the first B count data (GBH) to the comparator 670.

The second summer 650 outputs second summation data 651 that is a summation of the second R count data (GRM), the second G count data (GGM) and the second B count data (GBM) to the comparator 670.

The third summer 660 outputs third summation data 661 that is a summation of the third R count data (GRL), the third G count data (GGL) and the third B count data (GBL) to the comparator 670.

The comparator 670 compares the first, second and third summation data 641, 651 and 661 to output the gray-scale state signal 111*a*.

Figure 8:
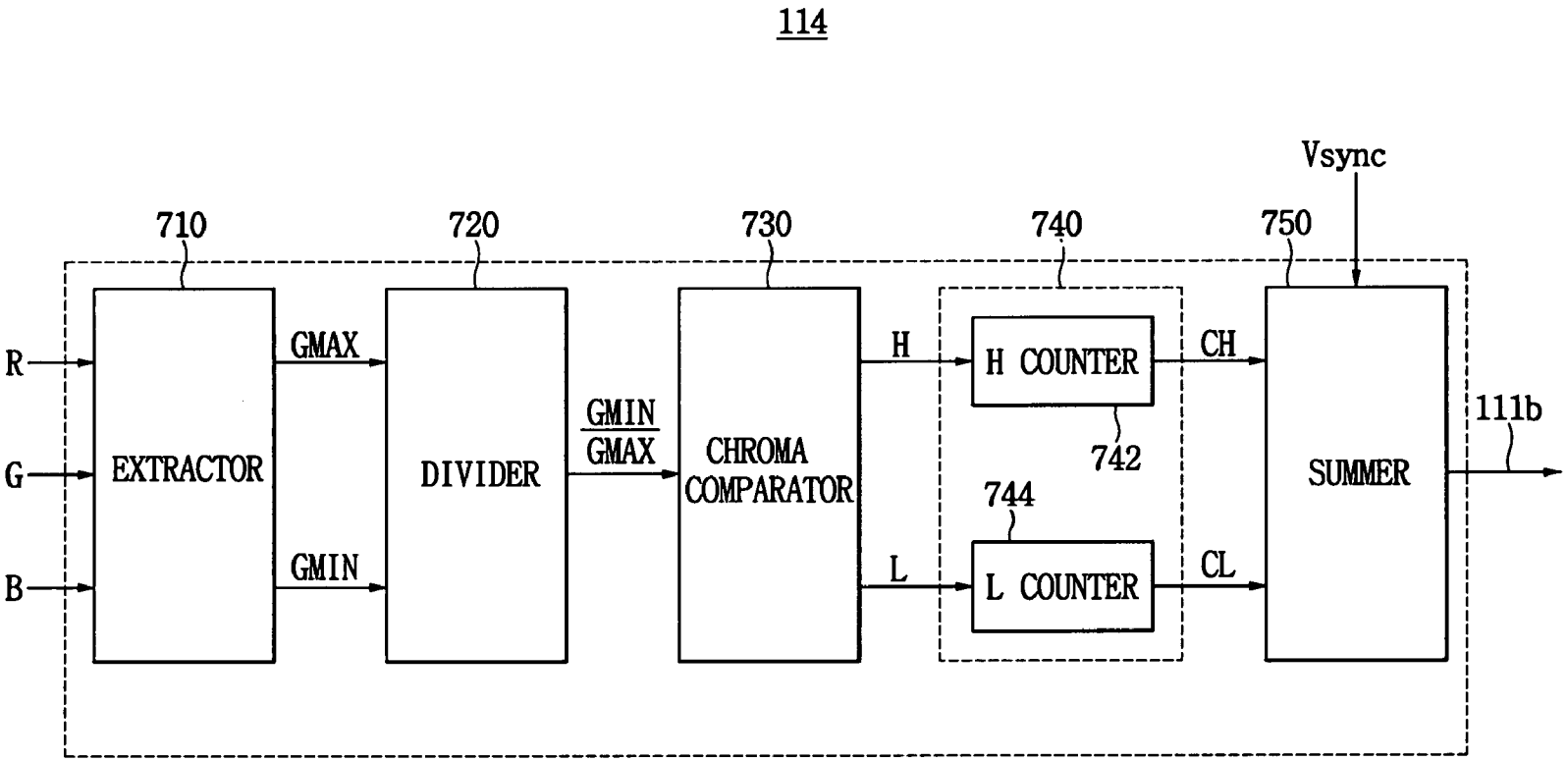
FIG. 8 is a schematic view showing the chroma discriminator of FIG. 6.

FIG. 8 is a schematic view showing the chroma discriminator of FIG. 6.

Referring to FIG. 8, the chroma discriminator 114 includes an extractor 710, a divider 720, a chroma comparator 730, a counting part 740 and a summer 750.

The extractor 710 extracts a maximum primary image signal (GMAX) and a minimum primary image signal (GMIN) from the first to third primary image signals to output the maximum and minimum primary image signals (GMAX and GMIN) to the divider 720.

The divider 720 divides the minimum primary image signal (GMIN) by the maximum primary image signal (GMAX) to output the divided data (GMIN/GMAX) to the chroma comparator 730.

The chroma comparator 730 outputs a high chroma state (H) or a low chroma state (L) to the counting part 740 in response to the divided data (GMIN/GMAX).

The counting part 740 includes a high counter 742 and a low counter 744. The high and low counters 742 and 744 count the numbers of the high and low chroma states (H and L) to output counted numbers (CH and CL) corresponding to the high and low chroma states (H and L) to the summer 750.

The summer 750 compares the counted number (CH) corresponding to the high chroma state (H) with the counted number (CL) corresponding to the low chroma state (L) during a frame to output the chroma state signal 111*b* corresponding to the high chroma state (H) or the low chroma state (L) to the multi-color transformer 120 and the backlight controller 130. The frame is determined by the vertical synchronizing signal (Vsync) that is provided to the chroma discriminator 114.

For example, when the counted number (CH) corresponding to the high chroma state (H) is about twice the counted number (CL) corresponding to the low chroma state (L), the summer 750 outputs the chroma state signal 111*b* corresponding to the high chroma state (H) to the multi-color transformer 120 and the backlight controller 130. When the counted number (CH) corresponding to the high chroma state (H) is about a half of the counted number (CL) corresponding to the low chroma state (L), the summer 750 outputs the chroma state signal 111*b* corresponding to the low chroma state (L) to the multi-color transformer 120 and the backlight controller 130. When the counted numbers (CH and CL) corresponding to the high and low chroma states (H and L) are substantially the same, the summer 750 outputs the chroma state signal 111*b* corresponding to the middle chroma state (M) to the multi-color transformer 120 and the backlight controller 130.

Figure 9:
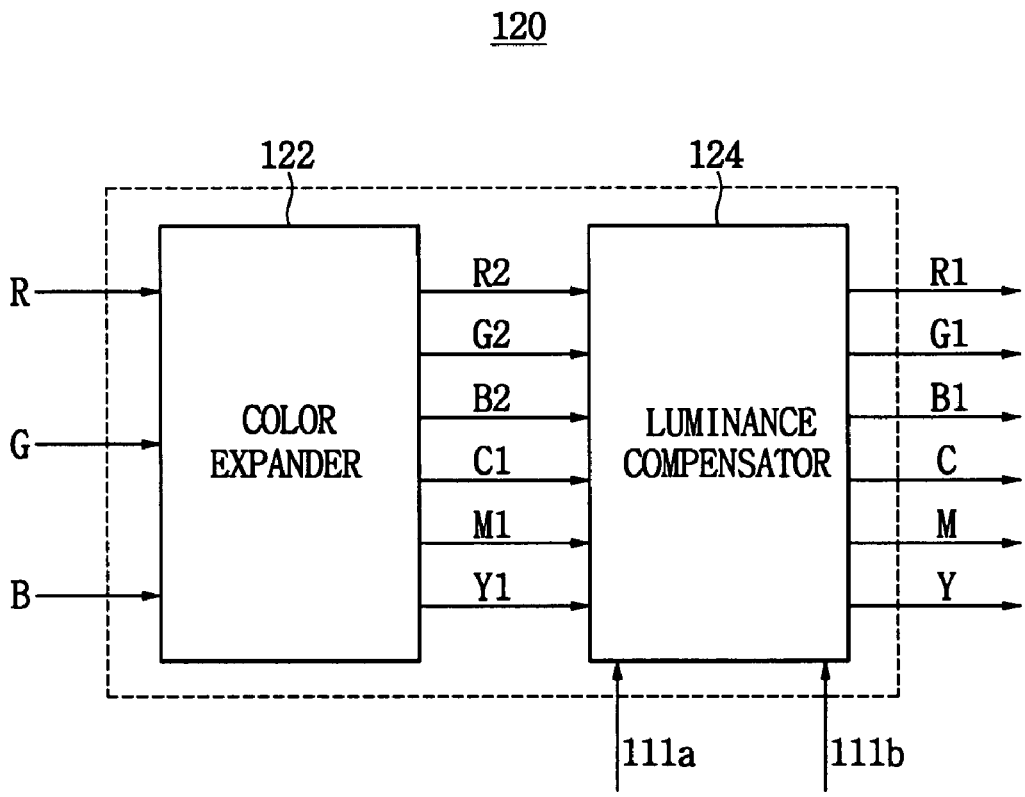
FIG. 9 is a schematic view showing the multi-color transformer of FIG. 2.

FIG. 9 is a schematic view showing the multi-color-transformer of FIG. 2.

Referring to FIG. 9, the multi-color transformer 120 includes a color expander 122 and a luminance compensator 124. The multi-color transformer 120 transforms the primary image signals (R, G and B) to the multi-color image signals (R1, G1, B1, C, M and Y) in response to the gray-scale state signal 111*a* and the chroma state signal 111*b* to output the multi-color image signals (R1, G1, B1, C, M and Y) to the data driver 200.

The color expander 122 transforms the primary image signals (R, G and B) to primary multi-color image signals (R2, G2, B2, C1, M1 and Y1) to output the primary multi-color image signals (R2, G2, B2, C1, M1 and Y1) to the luminance compensator 124.

The luminance compensator 124 compensates luminance of the primary multi-color image signals (R2, G2, B2, C1, M1 and Y1) in response to the gray-scale state signal 111*a* and the chroma state signal 111*b* to output the multi-color image signals (R1, G1, B1, C, M and Y) to the data driver 200.

The display apparatus according to various exemplary embodiments of the present invention is operated using an adaptive color-transformation and a luminance control so that the color reproducibility of the LCD apparatus is increased even when the primary image signals include high chroma, low chroma or a mixture thereof.

The gray-scales of multi-color signals are adjusted in response to the gray-scale state and the chroma state of the primary image signals, and the intensity of a backlight is controlled in response to the primary image signals to display the multi-colored image. Therefore, the image display quality is improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of displaying an image using an image display device, the image display device comprising an artificial light source, the method comprising:

inputting primary image signals to the image display device;

determining chroma state of the primary image signals for each image frame;

determining gray-scale state of the primary image signals for each image frame; and transforming the primary image signals to multi-color image signals and controlling luminance of the artificial light source, in response to the determined chroma state and gray-scale state of the primary image signals.

2. The method of claim 1, wherein the step of determining chroma state of the primary image signals comprises determining whether the primary signals are in a low chroma state, a middle chroma state or a high chroma state.

3. The method of claim 2, wherein the step of determining gray-scale state of the primary image signals comprises determining whether the primary signals are in a low gray-scale state, a middle gray-scale state or a high gray-scale state.

4. The method of claim 3, wherein, when the primary image signals are in a high chroma state and a low gray-scale state, the step of transforming the primary image signals to multi-color image signals and controlling luminance of the artificial light source comprises increasing the gray-scale of gray-scale data corresponding to the primary image signals and normally operating the artificial light source.

5. The method of claim 3, wherein, when the primary image signals are in a high chroma state and a high gray-scale state, the step of transforming the primary image signals to multi-color image signals and controlling luminance of the artificial light source comprises increasing the luminance of the artificial light source.

6. The method of claim 3, wherein, when the primary image signals are in a low chroma state, the step of transforming the primary image signals to multi-color image signals and controlling luminance of the artificial light source comprises normally operating the artificial light source.

7. The method of claim 3, wherein, when the primary image signals include a mixture of primary image signals in a high chroma state and a low gray-scale state and primary image signals in a low chroma state and a low gray-scale state, the step of transforming the primary image signals to multi-color image signals and controlling luminance of the artificial light source comprises increasing the gray-scale of gray-scale data corresponding to the high chroma state image signals and normally operating the artificial light source.

8. The method of claim 3, wherein, when the primary image signals include a mixture of primary image signals in a high chroma state and a low gray-scale state and primary image signals in a low chroma state and a high gray-scale state, the step of transforming the primary image signals to multi-color image signals and controlling luminance of the artificial light source comprises increasing the gray-scale of gray-scale data corresponding to the high chroma state image signals and normally operating the artificial light source.

9. The method of claim 3, wherein, when the primary image signals include a mixture of primary image signals in a high chroma state and a high gray-scale state and primary image signals in a low chroma state and a low gray-scale state, the step of transforming the primary image signals to multi-color image signals and controlling luminance of the artificial light source comprises normally operating the artificial light source or increasing the luminance of the artificial light source.

10. The method of claim 3, wherein, when the primary image signals include a mixture of primary image signals in a high chroma state and a high gray-scale state and primary image signals in a low chroma state and a high gray-scale state, the step of transforming the primary image signals to multi-color image signals and controlling luminance of the artificial light source comprises decreasing the gray-scale of gray-scale data corresponding to the high chroma state image signals and increasing the luminance of the artificial light source.

11. The method of claim 1, wherein the step of determining the chroma state comprises:

extracting a minimum gray scale and a maximum gray scale from the primary image signals;

dividing the minimum gray scale by the maximum gray scale of the primary image signals to output divided data;

outputting a high chroma state or a low chroma state in response to the divided data;

counting the number of high and low chroma states; and comparing the number of high chroma states with the number of low chroma states to determine the chroma state of the present frame.

12. The method of claim 2, wherein the step of determining the gray-scale state comprises:

determining the number of primary image signals in a high gray-scale state, the number of primary image signals in a middle gray-scale states and the number of primary image signals in a low gray-scale state; and comparing the number of primary image signals in a high gray-scale state, the number of primary image signals in a middle gray-scale state and the number of primary image signals in a low gray-scale state to determine the gray-scale state of the present frame.

13. An image display apparatus comprising:

a transformation controller that transforms primary image signals to multi-color image signals and outputs a luminance control signal, in response to determined chroma state and gray-scale state of the primary image signals;

a data driver that outputs data signals in response to the multi-color image signals;

a scan driver that successively outputs scan signals;

a display panel that displays an image corresponding to the data signals in response to the scan signals; and a light source that supplies light to the display panel in response to the luminance control signal.

14. The image display apparatus of claim 13, wherein the transformation controller comprises:

a gray-scale discriminator that discriminates a gray-scale state of each of the primary signals to output a gray-scale state signal;

a chroma discriminator that discriminate a chroma state of each of the primary signals to output a chroma state signal;

a multi-color transformer that transforms primary image signals to multi-color image signals in response to the gray-scale state signal and the chroma state signal; and a backlight controller that outputs the luminance control signal in response to the gray-scale state signal and the chroma state signal.

15. The image display apparatus of claim 14, wherein the chroma discriminator comprises:

an extractor that extracts a minimum gray scale and a maximum gray scale from the primary image signals;

a divider that divides the minimum gray scale by the maximum gray scale of the primary image signals to output divided data;

a chroma comparator that outputs a high chroma state or a low chroma state in response to the divided data;

a counter that counts the number of high and low chroma states; and a summer that compares the number of high chroma states with the number of low chroma states to output the chroma state signal.

16. The image display apparatus of claim 14, wherein the gray-scale discriminator comprises:

a first summer that determines the number of primary image signals in a high gray-scale state;

a second summer that determines the number of primary image signals in a middle gray-scale states;

a third summer that determines the number of primary image signals in a low gray-scale state; and a comparator that compares the number of primary image signals in a high gray-scale state, the number of primary image signals in a middle gray-scale state and the number of primary image signals in a low gray-scale state to determine the gray-scale state of the present frame.

17. The image display apparatus of claim 14, wherein the multi-color transformer comprises:

a color expander that transforms the primary image signals to primary multi-color image signals; and a luminance compensator that compensates luminance of the primary multi-color image signals in response to the gray-scale state signal and the chroma-state signal to output multi-color image signals.

18. A method for driving an image display apparatus, the image display apparatus comprising a display panel and a light source, the method comprising:

inputting primary image signals to the image display apparatus;

determining chroma state of the primary image signals for each image frame;

determining gray-scale state of the primary image signals for each image frame;

transforming the primary image signals to multi-color image signals and outputting a luminance control signal, in response to the determined chroma state and gray-scale state of the primary image signals;

applying image data to the display panel in response to the multi-color image signals; and controlling the light source in response to the luminance control signal to output light to the display panel.

19. The method of claim 18, wherein the step of determining chroma state of the primary image signals comprises determining whether the primary signals are in a low chroma state, a middle chroma state or a high chroma state.

20. The method of claim 19, wherein the step of determining gray-scale state of the primary image signals comprises determining whether the primary signals are in a low gray-scale state, a middle gray-scale state or a high gray-scale state.

21. The method of claim 20, wherein, when the primary image signals are in a high chroma state and a low gray-scale state, the step of transforming the primary image signals to multi-color image signals and controlling luminance of the artificial light source comprises increasing the gray-scale of gray-scale data corresponding to the primary image signals and normally operating the artificial light source.

22. The method of claim 20, wherein, when the primary image signals are in a high chroma state and a high gray-scale state, the step of transforming the primary image signals to multi-color image signals and controlling luminance of the artificial light source comprises increasing the luminance of the artificial light source.

23. The method of claim 20, wherein, when the primary image signals are in a low chroma state, the step of transforming the primary image signals to multi-color image signals and controlling luminance of the artificial light source comprises normally operating the artificial light source.

24. The method of claim 20, wherein, when the primary image signals include a mixture of primary image signals in a high chroma state and a low gray-scale state and primary image signals in a low chroma state and a low gray-scale state, the step of transforming the primary image signals to multi-color image signals and controlling luminance of the artificial light source comprises increasing the gray-scale of gray-scale data corresponding to the high chroma state image signals and normally operating the artificial light source.

25. The method of claim 20, wherein, when the primary image signals include a mixture of primary image signals in a high chroma state and a low gray-scale state and primary image signals in a low chroma state and a high gray-scale state, the step of transforming the primary image signals to multi-color image signals and controlling luminance of the artificial light source comprises increasing the gray-scale of gray-scale data corresponding to the high chroma state image signals and normally operating the artificial light source.

26. The method of claim 20, wherein, when the primary image signals include a mixture of primary image signals in a high chroma state and a high gray-scale state and primary image signals in a low chroma state and a low gray-scale state, the step of transforming the primary image signals to multi-color image signals and controlling luminance of the artificial light source comprises normally operating the artificial light source or increasing the luminance of the artificial light source.

27. The method of claim 20, wherein, when the primary image signals include a mixture of primary image signals in a high chroma state and a high gray-scale state and primary image signals in a low chroma state and a high gray-scale state, the step of transforming the primary image signals to multi-color image signals and controlling luminance of the artificial light source comprises decreasing the gray-scale of gray-scale data corresponding to the high chroma state image signals and increasing the luminance of the artificial light source.

28. The method of claim 18, wherein the step of determining the chroma state comprises:

extracting a minimum gray scale and a maximum gray scale from the primary image signals;

dividing the minimum gray scale by the maximum gray scale of the primary image signals to output divided data;

outputting a high chroma state or a low chroma state in response to the divided data;

counting the number of high and low chroma states; and comparing the number of high chroma states with the number of low chroma states to determine the chroma state of the present frame.

29. The method of claim 19, wherein the step of determining the gray-scale state comprises:

determining the number of primary image signals in a high gray-scale state, the number of primary image signals in a middle gray-scale states and the number of primary image signals in a low gray-scale state; and comparing the number of primary image signals in a high gray-scale state, the number of primary image signals in a middle gray-scale state and the number of primary image signals in a low gray-scale state to determine the gray-scale state of the present frame.

30. An apparatus for driving an image display panel, the image display panel comprising a plurality of gate lines, a plurality of data lines, a switching element electrically connected to one of the gate lines and one of the data lines, and a pixel electrode electrically connected to the switching element, the display panel displaying an image corresponding to data signals in response to scan signals, the apparatus comprising:

a transformation controller that transforms primary image signals to multi-color image signals and outputs a luminance control signal, in response to determined chroma state and gray-scale state of the primary image signals;

a data driver that outputs the data signals to the plurality of data lines in response to the multi-color image signals;

a scan driver that successively outputs the scan signals to the plurality of gate lines; and a light source that supplies light to the display panel in response to the luminance control signal.

31. The apparatus of claim 30, wherein the transformation controller comprises:

a gray-scale discriminator that discriminates a gray-scale state of each of the primary image signals to output a gray-scale state signal;

a chroma discriminator that discriminate a chroma state of each of the primary signals to output a chroma state signal;

a multi-color transformer that transforms primary image signals to multi-color image signals in response to the gray-scale state signal and the chroma state signal; and a backlight controller that outputs the luminance control signal in response to the gray-scale state signal and the chroma state signal.

32. The apparatus of claim 31, wherein the chroma discriminator comprises:

an extractor that extracts a minimum gray scale and a maximum gray scale from the primary image signals;

a divider that divides the minimum gray scale by the maximum gray scale of the primary image signals to output divided data;

a chroma comparator that outputs a high chroma state or a low chroma state in response to the divided data;

a counter that counts the number of high and low chroma states; and a summer that compares the number of high chroma states with the number of low chroma states to output the chroma state signal.

33. The apparatus of claim 31, wherein the gray-scale discriminator comprises:

a first summer that determines the number of primary image signals in a high gray-scale state;

a second summer that determines the number of primary image signals in a middle gray-scale states;

a third summer that determines the number of primary image signals in a low gray-scale state; and a comparator that compares the number of primary image signals in a high gray-scale state, the number of primary image signals in a middle gray-scale state and the number of primary image signals in a low gray-scale state to determine the gray-scale state of the present frame.

34. The apparatus of claim 31, wherein the multi-color transformer comprises:

a color expander that transforms the primary image signals to primary multi-color image signals; and a luminance compensator that compensates luminance of the primary multi-color image signals in response to the gray-scale state signal and the chroma-state signal to output multi-color image signals.

* * * * *